US006129029A

United States Patent [19]

Watson

[11] Patent Number: 6,129,029

[45] Date of Patent: Oct. 10, 2000

[54] METHOD AND APPARATUS FOR ACCESSING SAFE DEPOSIT BOX

[76] Inventor: Ronald R. Watson, 7716 E. Lewis, Scottsdale, Ariz. 85027

[21] Appl. No.: 09/138,820

[22] Filed: Aug. 21, 1998

[51] Int. Cl.[7] ..... E05G 1/00

[52] U.S. Cl. ..... 109/56; 70/337; 70/429; 109/67

[58] Field of Search ..... 109/9, 6, 56, 57, 109/67, 424, 455; 70/337, 158, DIG. 43, 429, 430, DIG. 56, 63

[56] References Cited

U.S. PATENT DOCUMENTS

| | | | |
|---|---|---|---|
| 1,293,616 | 2/1919 | Norton | 70/430 |
| 1,307,253 | 6/1919 | Griffith | 70/429 |
| 3,475,934 | 11/1969 | Reisner | 70/455 |
| 3,861,182 | 1/1975 | Skinner | 70/455 |
| 4,118,962 | 10/1978 | Block et al. | 70/455 |
| 5,495,733 | 3/1996 | Yen et al. | 70/279 |
| 5,701,828 | 12/1997 | Benore et al. | 109/56 |

FOREIGN PATENT DOCUMENTS

| | | |
|---|---|---|
| 850940 | 9/1952 | Germany . |

*Primary Examiner*—Darnell M. Boucher
*Attorney, Agent, or Firm*—Tod R. Nissle, P.C.

[57] ABSTRACT

A method and apparatus for accessing a safe deposit box stored in a vault. The safe deposit box includes a customer lock and a bank lock, each of which must be opened to access the box. Apparatus is provided to permanently maintain the bank lock in an open position and to enable a customer to enter the vault without requiring the assistance of a bank teller.

2 Claims, 4 Drawing Sheets

METHOD AND APPARATUS FOR ACCESSING SAFE DEPOSIT BOX

This invention relates to an apparatus and method for accessing a safe deposit box.

In a further respect, the invention relates to a method and apparatus for accessing a vault to gain entry to a safe deposit box.

For over one hundred years, banks routinely have maintained safe deposit boxes as a convenience for their customers. Each safe deposit box includes a pair of locks. One lock on a safe deposit box is opened with a key retained by a customer. The other lock on the box is opened with a key, called a "guard-key", retained by the bank.

When a customer wishes to access his or her safe deposit box, the customer travels to the appropriate bank and asks a teller at the bank for assistance. The teller obtains the key to the vault daygate, obtains the bank's guard-key for the customer's safe deposit box, opens the daygate to the bank vault for the customer, and, along with the customer, opens the customer's safe deposit box with the guard-key. The teller typically then either stands back or leaves to allow the customer to examine the contents of the customer's safe deposit box or to take the safe deposit box to a viewing room outside the vault. When the customer is ready to leave (if the customer examined the safe deposit box in the vault) or is ready to reenter the vault (if the customer examined the safe deposit box in a room outside the vault), the bank teller returns. The teller and the customer use their keys to lock the customer's box, after which both exit the vault. The foregoing procedure is time-consuming and is likely, when many customers are waiting to examine their safe deposit boxes, to result in at least one customer who is upset with the bank because of the time required to access his or her safe deposit box. Banks have lost valuable customers because of the customers' ire at delays in accessing their deposit boxes.

Accordingly, it would be highly desirable to provide an improved apparatus and method for accessing a customer's safe deposit box.

Therefore, it is a principal object of the instant invention to provide an improved method and apparatus for accessing a safe deposit box.

A further object of the invention is to provide an improved method and apparatus for accessing a bank vault to gain entry to a safe deposit box in the vault.

Another object of the invention is to provide an improved method and apparatus for accessing a safe deposit box to reduce significantly the amount of time expended by a bank employee and by a customer in accessing the safe deposit box.

These and other, further and more specific objects and advantages of the invention will be apparent to those skilled in the art from the following detailed description thereof, taken in conjunction with the drawings, in which.

Figure 1:
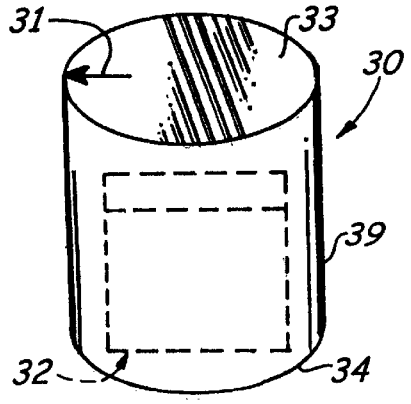
FIG. 1 is a top isometric view illustrating a key engaging apparatus utilized to facilitate access of a safe deposit box.
Figure 2:
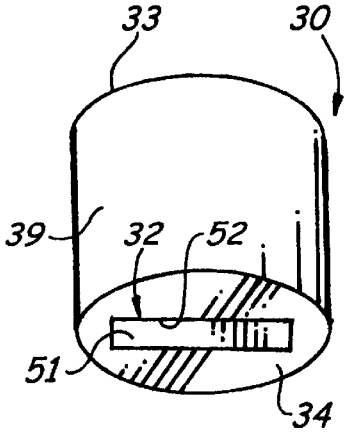
FIG. 2 is a bottom isometric view of the key engaging apparatus of FIG. 1 further illustrating construction details thereof.
Figure 3:
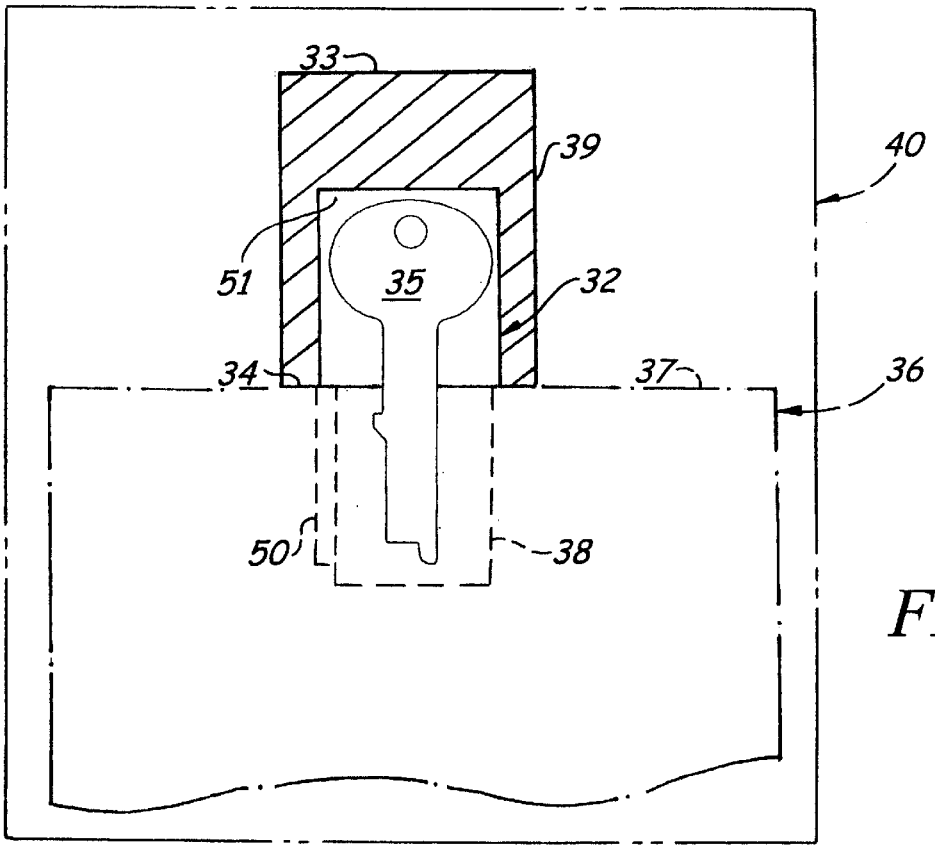
FIG. 3 is a side elevation view of the key engaging apparatus of FIGS. 1 and 2 illustrating the mode of operation thereof.
Figure 3A:
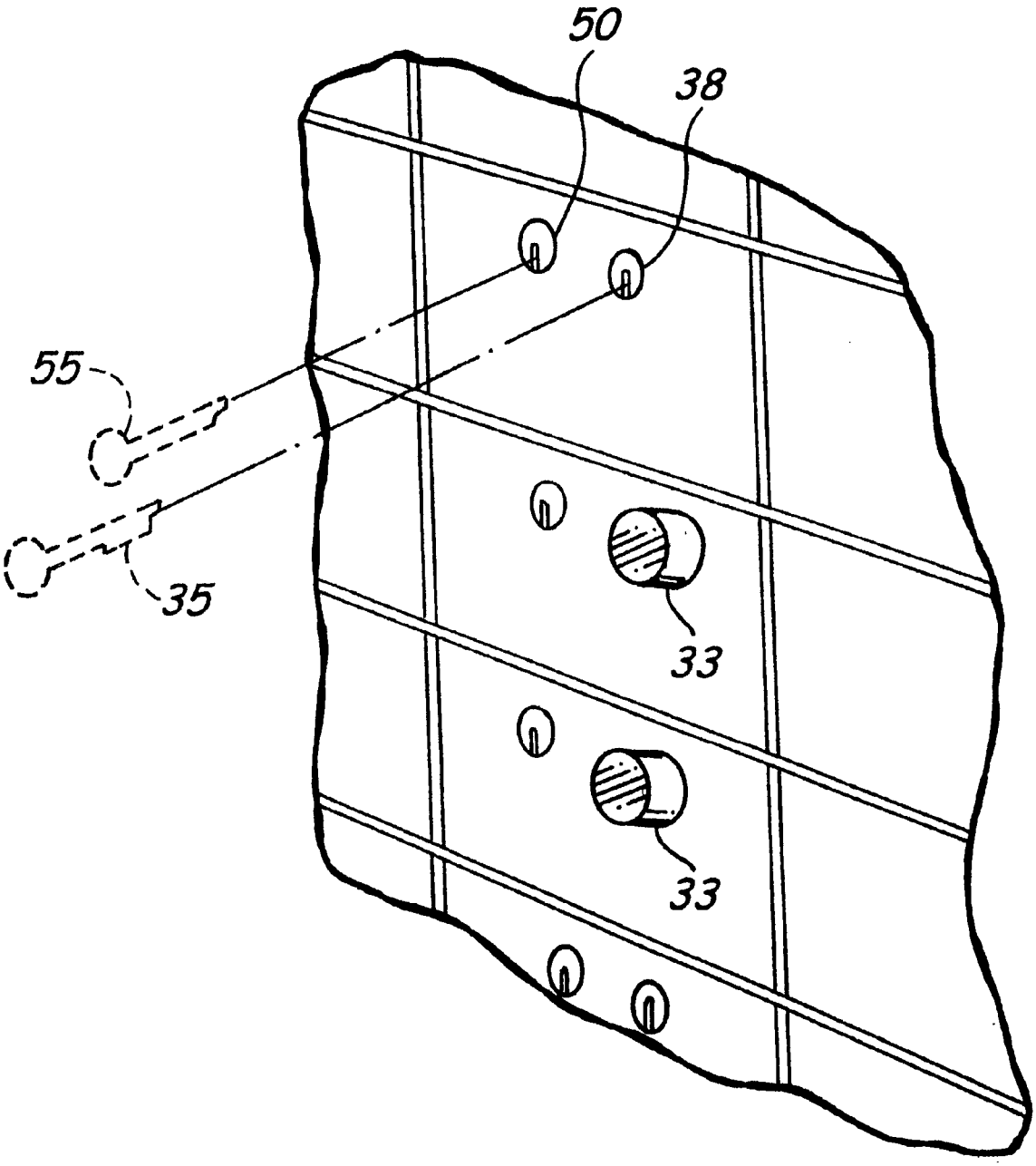
FIG. 3A is a front view of a plurality of safe deposit boxes with the key engaging apparatus permanently affixed thereto.

Briefly, in accordance with my invention, I provide an improved storage system for safe keeping of a customer's valuable property. The improved storage system includes a vault; and, a plurality of safe deposit boxes stored in the vault and each including a first lock mounted in the box, a first key for opening the first lock, a second lock mounted in the box, and, a second key inserted in the second lock in a fixed position in which the second lock is opened. The improved storage system also includes apparatus mounted on each of the safe deposit boxes to engage the second key and permanently maintain the second key in its fixed position.

In a further embodiment of my invention, I provide an improved method for modifying a vault to facilitate a customer's accessing the vault. The vault includes an entrance; and, a plurality of safe deposit boxes stored in the vault and each including a first lock mounted in the box, a first key for opening the first lock, a second lock mounted in the box, and a second key. The second key is inserted in the second lock and is movable between at least two operative positions when inserted, a first operative position with the second lock locked, and, a second operative position with the second lock unlocked. The improved method includes the steps of inserting in each of the safe deposit boxes the second key in the second lock and moving the second key to the second operative position; and, permanently securing the second key in the second operative position.

In another embodiment of my invention, I provide an improved access system in combination with a storage area in a financial institution. The storage area includes a vault; a door for accessing the vault; and, a plurality of safe deposit boxes stored in the vault. Each safe deposit box include a first lock mounted in the box; a first key for opening the first lock; a second lock mounted in the box; and, a second key for opening the second lock. The improved access system facilitates access to the storage area and includes a camera in the vault to photograph a customer entering the vault through the door; and, a control. The control receives, processes, and validates customer identification information; opens the door when the customer identification information is validated; and, transmits a control signal to the camera when the customer identification information is validated. The improved access system also includes apparatus at the vault door for inputting customer identification information to the control.

In still a further embodiment of my invention, I provide an improved method for equipping a vault to facilitate access to the vault. The vault includes a door for accessing the vault; and, a plurality of safe deposit boxes stored in the vault. Each safe deposit box includes a first lock mounted in the box; a first key for opening the first lock; a second lock mounted in the box; and, a second key for opening the second lock. The improved method includes the steps of installing a camera in the vault to photograph a customer entering the vault through the door; and, installing a control. The control receives, processes, and validates customer identification information; opens the door when the customer identification information is validated; and, transmits a control signal to the camera when the customer identification information is validated. The improved method also includes the step of installing communication apparatus at the door for inputting customer identification information to the control. The improved method can also include the step of installing apparatus for maintaining audio surveillance in said vault.

Turning now to the drawings, which depict the presently preferred embodiment of the invention for the purpose of illustrating the practice thereof and not by way of limitation of the scope of the invention, and in which like reference characters refer to corresponding elements throughout the several views, FIGS. 1 to 5 illustrate an access and storage system constructed in accordance with the invention. The system includes a vault 40 (FIG. 3) having an entrance provided with a day gate and a day gate lock 20 (FIG. 4) in the day gate. One or more safe deposit boxes 36 are stored in the vault 40. Each box 36 includes a pair of side-by-side locks 50, 38. Each lock must be opened to open the safe deposit box. The first lock 50 on a box 36 ordinarily is opened with a key 55 carried and provided by the customer. The first lock 50 is therefore referred to herein as the customer lock. The second lock 38 on box 36 ordinarily is opened with a guard-key 35 provided by the owner of the vault 40, which owner is typically a bank, savings and loan, credit union, or other financial institution. The second lock 38 is therefore referred to herein as the bank guard-lock. Guard-key 35 and the other key utilized to open box 36 are each operated in conventional fashion by inserting the distal end of the key in the appropriate lock, by manually grasping the proximate end or head of the key, and by turning the key to open the lock. In the practice of the invention, the guard-key 35 is inserted in bank guard-lock 38, is turned to the position at which bank guard-lock 38 is open, and is permanently maintained in this position (such that bank guard-lock 38 is permanently open) by sliding rectangular slot 32 of cylindrical member 30 over the head of key 35 in the manner shown in FIG. 3 such that adhesive layer 34 on the bottom of member 30 contacts the face plate 37 of drawer 36 and permanently secures member 30 to plate 37 in the position illustrated in FIG. 3. When member 30 is permanently secured in the position illustrated in FIG. 3, guard-key 35 is maintained in bank guard-lock 38 in a position which maintains bank guard-lock 38 in a permanently open position. Each safe deposit box 36 can, if desired, include only a single lock 50 and not be equipped with a guard lock 38.

Member 30 also includes upper circular surface 33, outer cylindrical surface 39, and arrow 31 formed on surface 33 to indicate the location and orientation in member 30 of the slot 32. The orientation of slot 32 in member 33 can also be indicated by forming member 30 with a dimension or shape which corresponds to and indicates the orientation of slot 32 in member 33. Arrow 31 indicates the orientation of slot 32 in member 33 because arrow 31 is parallel to and coincident with an imaginary plane which both bisects slot 32 and is spaced apart and parallel to the opposing parallel spaced apart pair of rectangular sides 51, 52 of slot 32 which sides each have a greater surface area than the other pair of opposing parallel spaced apart pair of rectangular side of slot 32.

As will be appreciated by those of skill in the art, any desired means can be utilized to secure a guard-key 35 in bank guard-lock 38 a position to maintain the bank guard-lock 38 of a safe deposit box open. By way of example and not limitation, guard-key 35 can be welded in a fixed position or the bank guard-lock 38 can be secured in an open position without requiring that guard-key 38 be continuously inserted in bank guard-lock 38, i.e., guard-key 35 is inserted in guard-lock 38 and used to open guard-lock 38, after which guard-lock 38 is welded or otherwise permanently secured in an open position and key 35 is removed from guard-lock 38.

Figure 4:
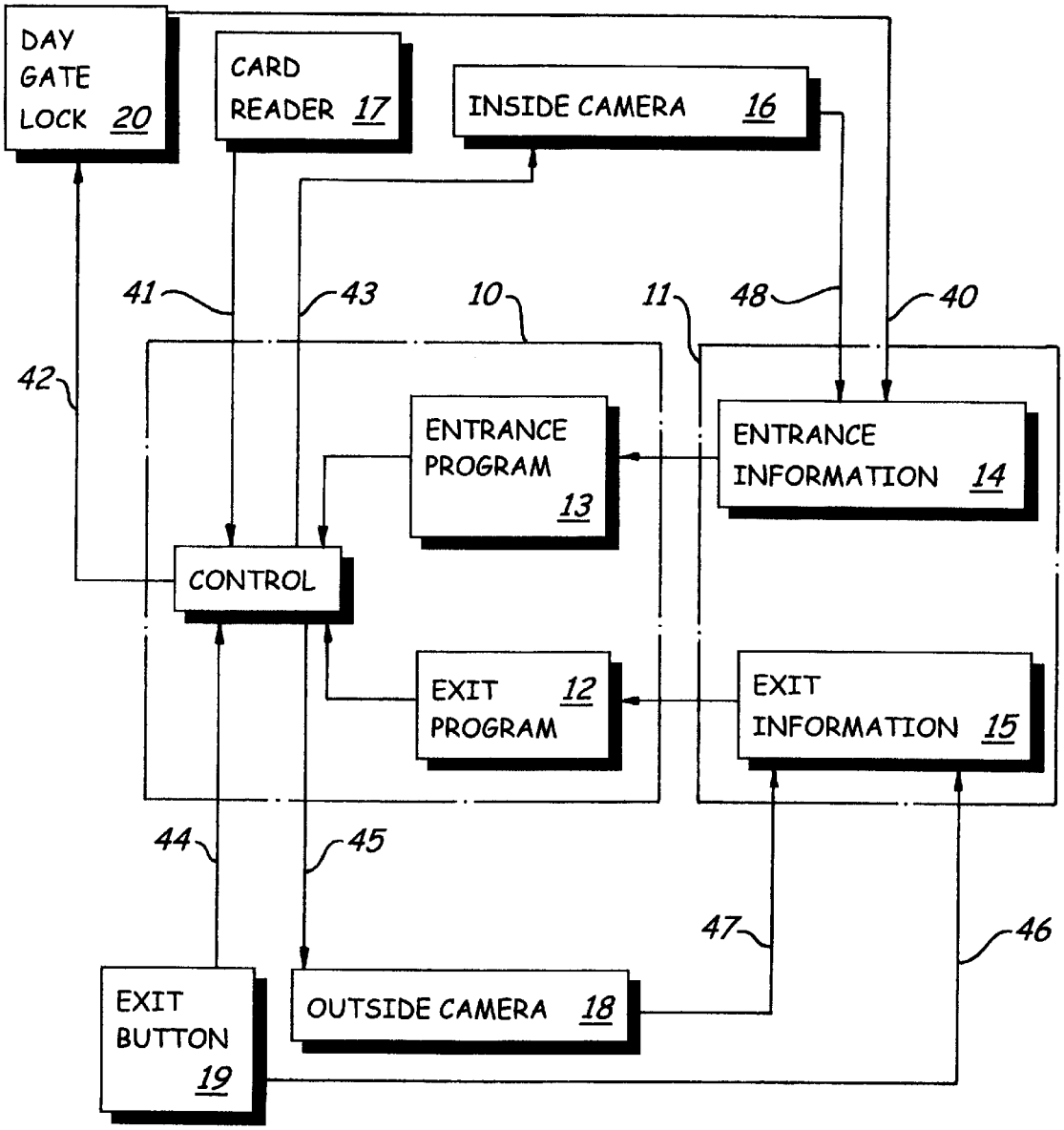
FIG. 4 is a block diagram illustrating safe deposit box accessing apparatus constructed in accordance with the invention; and, FIG. 5 is a logic flow diagram illustrating the mode of operation of software which can be utilized in the apparatus of FIG. 4.

Additional components of the access and storage system of the invention are illustration in FIG. 4. A microprocessor or other computer or control device is mounted in vault 40, outside of vault 40, or at any other desired location in or remote from the building or other location in or at which vault 40 is located. The microprocessor includes controller 10 and memory 11. The controller 10 includes an entrance program 13 and an exit program 12. Memory 11 includes entrance information 14 and exit information 11.

While entrance information 14 can vary as desired, such information presently includes desired customer identification data for each customer expected to access a safe deposit box in vault 40. Since in many cases the vault 40 is owned by a bank, the customer identification data can include the number on the customer's bank card, the expiration date of the card, and the customer's PIN number. The customer's name and address, birth date, social security number, and any other desired customer identification information can be stored in entrance information 14. Such customer identification information is utilized by the entrance program 13 of controller 10 to confirm the identity of a customer attempting to access vault 40. The entrance information can also, if desired, included digitized data sent 48 by camera 16 to define the picture(s) of the customer taken by camera 16 when the customer enters vault 40 through the day gate or other entrance to vault 40. Alternatively, such data can be stored in camera 16 or at another desired location. The data sent 48 or stored in camera 16 or at another desired location can, if desired, be digitized.

The exit information 15 can include any desired information, but presently includes information used by exit program 12 of controller 10 to open day gate lock 20 when exit button 19 is touched, depressed, or otherwise activated by a customer who is inside vault 40 and wishes to exit vault 40. Exit information 15 can also include digitized data sent 46 from camera 18 to define the picture(s) of the customer taken by camera 18 when the customer exits vault 40 through the day gate or other entrance to vault 40. Alternatively, such data can be stored in camera 18 or another desired location in an analog, digital, or other desired format.

A card reader 17 is ordinarily mounted at or adjacent to the day gate to the vault but can be mounted at any desired location where it is accessible to a customer standing outside the vault. Card reader 17 presently preferably includes a magnetic strip reader for reading the customer identification information contained in magnetic strip on a bank card, ATM card, credit card, or other card and for sending 41, 40 a signal containing pertinent customer identification information to controller 10 and memory I 1, respectively. Reader 17 can include any other desired sensor means for reading customer identification information contained on or in a card or other member or apparatus utilized by a customer to gain entrance to vault 40. Reader 17 also presently preferably includes a numeric or alphanumeric key pad which permits a customer to enter his or her PIN number or other code number. Reader 17 can also include means for analyzing a customer's voice to identify the customer, for analyzing a customer's eye with a laser scan, and/or for genetically analyzing tissue or a cell from the customer, all to obtain information which facilitates uniquely defining and identifying the customer. A sign adjacent reader 17 instructs a customer to "INSERT AND REMOVE YOUR ATM CARD AND ENTER YOUR FOUR DIGIT PIN TO ENTER VAULT." Once a customer enters the vault 40, another customer who wishes to enter the vault 40 is altered by a warning sign which states: "ONE MOMENT PLEASE. VAULT IS OCCUPIED." This warning sign lights up as soon as a customer enters vault 40. Controller 10 will not allow another customer in vault 40 until the customer in the vault exits the vault. If a first customer leaves the vault and a second customer—without the second customer's entering customer identification information in reader 17—attempts to enter vault 40 through the day gate before the day gate closes behind the customer leaving vault, a sensor in vault 40 detects the presence of the second customer and sounds an alarm.

Day gate lock 20 receives 42 a signal from controller 10 which unlocks the day gate lock to permit a customer to enter vault 40 through the day gate.

Inside camera 16 is mounted inside vault 40 and receives 43 a signal from control 10 when a customer is entering vault 40 through the day gate. When a customer enters vault 40 through the day gate, camera 16 records a picture of the customer from the waist up, along with the date and time of day that the customer enters the vault 40. If desired, the camera 16 can photograph only the head and shoulders of the customer, can photograph the customer from head to toes, etc. When a customer enters vault 40, the customer see a prominently displayed sign: "IF YOU REQUIRE AN ASSISTANT, PLEASE LET US KNOW AND WE WILL BE HAPPY TO ASSIST YOU. THIS AREA IS UNDER CLOSED CIRCUIT TELEVISION AND AUDIO SURVEILLANCE AT ALL TIMES FOR YOUR PROTECTION."

Outside camera 18 is mounted outside vault 40 and receives 45 a signal from controller 10 when a customer is exiting vault 40 through the day gate. When a customer exits the vault 40 through the day gate, camera 18 records a picture of the customer from head to toes, along with the date and time of day that the customer exits the vault 40.

The exit button 19 is mounted inside vault 40, typically near the vault's day gate. When a customer inside the vault wishes to exit through the day gate, he or she depresses button 19 to send 44 a signal to controller 10. A sign near the exit button instructs a customer to "PUSH BUTTON TO EXIT THIS AREA." An intercom phone can be installed adjacent the exit button 19 or at any other location in vault 40. A sign adjacent the intercom phone instructs a customer to "FOR ASSISTANCE PICK-UP PHONE AND A TELLER WILL ASSIST YOU."

Figure 5:
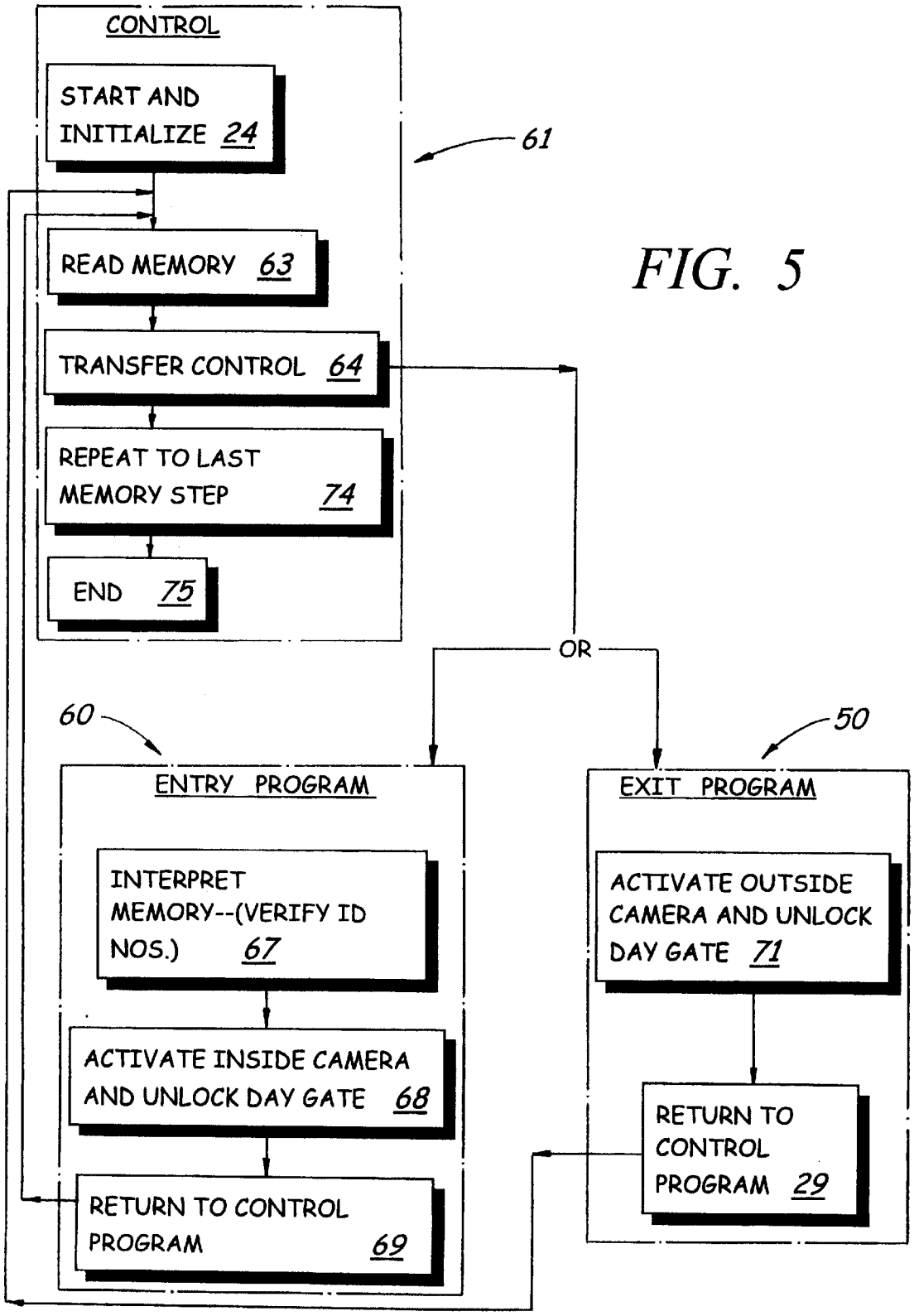

FIG. 5 is a block flow diagram which illustrates a typical program or logic function which is executed by the controller 10 to permit access to vault 40. The basic control program 61 consists of commands to "start and initialize" 62, "read memory" 63, and "transfer control" 64 to the entry program sub-routine 60 or the exit program sub-routine 50.

The entry program sub-routine 60 includes a command to "interpret memory" 67 (i.e., to determine if the customer identification information which is gathered by card reader 17 from a bank card or other source of information and which is received and processed by program 13 can be confirmed and validated). When the customer identification information is validated, the command "activate inside camera and unlock day gate" 68 causes controller 10 to activate 43 camera 16 and to open 42 the day gate or other entrance to the vault 40, followed by the command "return to control program" 69. In the event the customer identification information is not validated (which would be unusual), then controller 10 does not activate camera 16 and open the day gate 20 and the command "return to control program" 69 is followed.

The exit program sub-routine 50 includes a command to "activate inside camera and unlock day gate" 71 followed by "return to control program" 72. The exit program sub-routine 50 is activated whenever a customer in vault 40 depresses the exit button 19 to produce a signal 44 transmitted to controller 10.

In use, a bank or other business or financial institution has a vault or other secure area in which safe deposit boxes 36 are stored. Each safe deposit box 36 includes two locks, a customer lock and a bank lock, mounted side-by-side in the face 37 of the box. The customer lock is opened with a key kept by the customer. The bank lock is opened with a key kept by the bank.

The bank obtains a member 30 for each safe deposit box. The guard-key 35 for the bank guard-lock 38 on each box is inserted in the bank guard-lock by bank personnel who then turn the key to open the bank guard-lock. Member 30 is slid over the head of guard-key 35 such that contact adhesive 34 on the bottom surface of member 30 contacts and permanently adheres to the face 37 to permanently maintain guard-key 35 in a position which permanently maintains bank guard-lock 38 open.

The bank installs a microprocessor, installs a card reader 17 outside the day gate to the vault, installs a camera 16 which is inside the vault and is focused on the day gate to photograph a customer entering the vault, installs a camera 18 which is outside the vault and is focused on the day gate to photograph a customer leaving the vault, and, installs an exit button 19 which is inside the vault 40 and is depressed by a customer who wishes to exit vault 40. The microprocessor includes controller 10 and memory 11. Controller 10 includes entrance program 13 and exit program 12. Memory 11 includes entrance information 14 and exit information 15. The controller 10, camera 16, camera 18, card reader 17, exit button 19, and day gate lock 20 generally function in the manner earlier described herein.

A customer who is renting a safe deposit box 36 in vault 40 and has a key for the customer lock in the box 36 enters the bank and, after receiving permission from a teller, walks up to the day gate to vault 40. The customer uses his (or her) bank card by running the magnetic strip of the card through a card reader which is part of card reader 17. The customer also utilizes a keyboard on reader 17 to enter his PIN number. The PIN number and customer identification information contained in the magnetic strip of the customer's bank number are transmitted 41 to the controller 10 and to entrance information 14 in memory 11. Receipt of the customer identification information by controller 10 activates the entrance program 13. Program 13 processes 67 the customer identification information transmitted 41 by reader 17 by comparing the customer identification information to customer identification information which was earlier stored in entrance information 14. If such comparison confirms that the customer awaiting entry to vault 40 is a customer of the bank and has a safe deposit box in vault 40, the program validates the customer identification information received from reader 17 and authorizes activation of camera 16 and the unlocking of the day gate so the customer can walk through the day gate into vault 40. Controller 10 sends 42 a signal to the day gate lock 20 to unlock the day gate. Customer identification information ordinarily is validated by program 13 if it matches and corresponds to customer identification information earlier verified by the bank and entered into memory 11 as entrance information 14.

If the customer identification information received by the controller from reader 17 is validated by program 13, the controller also, in accordance with program 13, sends 43 a signal to camera 16. While signal 43 can perform any desired function with respect to camera 16, signal 43 presently turns on camera 16 while the customer enters vault 40 through the day gate. Camera 16 takes pictures of the customer while he (or she) walks through the day gate into the vault.

Once the customer is inside the vault 40, the customer goes to his safe deposit box and utilizes his key to open the customer lock on the box. Since the bank guard-lock on the box is maintained in a permanently open position by guard-key 35 and member 30 in the manner earlier described, once the customer uses his key to open the customer lock, the customer can remove the box 36 from its original location in vault 40 and examine to access the inside of the box. The customer then reinstalls the box in its original location and uses his key to lock the customer lock to secure the box in vault 40. The customer walks to the day gate and depresses button 19. Button 19 sends 44 a signal to the controller 10. Controller 10 activates the exit program 12. Program 12 directs 71 that camera 18 be activated and that the day gate be unlocked. Accordingly, controller 10 sends 42 a signal which unlocks lock 20 and sends 45 a signal which causes camera 18 to take photographs of the customer while he exits vault 40 through the day gate.

Photographs of a customer taken by cameras 16, 18 are transmitted 48, 47 to entrance information 14 and exit information 15, respectively, for storage and later recall. A camera(s) can be provided in the vault to view a customer when the customer is opening his or her safe deposit box. Such a camera(s) can, if desired, be utilized to view in whole or in part a customer during the entire time or a portion of the time the customer is in the vault.

If desired, in the practice of the invention the customer lock on a safe deposit box can be permanently maintained in an open position and the bank lock can be allowed to continue to function in its normal manner and can (instead of the customer lock) be used to open and close the safe deposit box.

Having described my invention in such terms as to enable those skilled in the art to understand and practice it and having described the presently preferred embodiments thereof,

I claim:

1. A storage system for safe keeping of a customer's valuable property, said system including (a) a vault;

(b) a plurality of safe deposit boxes stored in said vault and each including (i) a first lock mounted in said box, (ii) a first key for opening said first lock, (iii) a second lock mounted in said box, (iv) a second key inserted in said second lock in a fixed position in which said second lock is opened; and, (c) means mounted on each of said safe deposit boxes to engage said second key and permanently maintain said second key in said fixed position.

2. A method for modifying a vault to facilitate a customer's accessing the vault, said vault including (a) an entrance;

(b) a plurality of safe deposit boxes stored in said vault and each including (i) a first lock mounted in said box, (ii) a first key for opening said first lock, (iii) a second lock mounted in said box, (iv) a second key for insertion said second lock and movable between at least two operative positions when inserted in said lock, a first operative position with said lock locked, and a second operative position with said lock unlocked, said method including the steps of (a) inserting in each of said safe deposit boxes said second key in said second lock and moving said second key to said second operative position; and, (b) permanently securing said second key in said second operative position.

* * * * *